US005515805A

United States Patent [19]

Johanson

[11] Patent Number: 5,515,805

[45] Date of Patent: May 14, 1996

[54] FOLDING BOAT AND TRAILER

[76] Inventor: Daniel P. Johanson, 54 Pommogusset Rd., Rutland, Mass. 01543

[21] Appl. No.: 355,617

[22] Filed: Dec. 14, 1994

[51] Int. Cl.[6] ..... B63B 21/64

[52] U.S. Cl. ..... 114/344; 114/353

[58] Field of Search ..... 114/343, 344, 114/352, 353, 354, 363, 364, 218

[56] References Cited

U.S. PATENT DOCUMENTS

| | | | |
|---|---|---|---|
| 957,820 | 5/1910 | Vaniman | 114/352 |
| 3,462,781 | 8/1969 | Olvera | 114/344 |
| 3,822,427 | 7/1974 | Ewart | 114/352 |
| 4,373,463 | 2/1983 | Beaudette | 114/218 |
| 4,664,401 | 5/1987 | Carrick | 114/344 |
| 4,704,981 | 11/1987 | Agner | 114/218 |
| 4,827,865 | 5/1989 | Yelderman | 114/353 |

*Primary Examiner*—Stephen Avila

[57] ABSTRACT

A new and improved folding boat and trailer comprising a front section having an upper transverse portion and a lower transverse portion. The lower transverse portion has a female keel integral therewith. The female keel has two apertures formed therethrough. Included in the device is a back section having a generally rectangular configuration. The back section has an upper transverse portion and a lower transverse portion. The lower transverse portion has a male keel integral therewith. The male keel has two apertures therethrough. The upper transverse portion is hingedly secured to the upper transverse portion of the front section. The back section closes over the front section in a closed configuration. In an extended configuration the lower transverse portion of the back section adjoins the lower transverse portion of the front section with the male keel cooperating with the female keel with the associated apertures in alignment and secured together by nuts and bolts.

1 Claim, 3 Drawing Sheets

FOLDING BOAT AND TRAILER

BACKGROUND OF THE INVENTION

1. Field of the Invention

The present invention relates to a folding boat and trailer and more particularly pertains to providing an easy to assemble and easily transportable boat with a folding boat and trailer.

2. Description of the Prior Art

The use of folding boats is known in the prior art. More specifically, folding boats heretofore devised and utilized for the purpose of folding two parts of a boat together are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,183,002 to Parker discloses a folding and nesting boat that has two configurations, a package configuration and a boat configuration.

U.S. Pat. No. 4,522,143 to Holzbaur discloses a folding boat with bow and stern sections.

U.S. Pat. No. 4,180,881 to Speranza discloses a folding transportable boat formed by resin-impregnated fiberglass.

U.S. Pat. No. 4,075,724 to Hire discloses a folding boat having a plurality of open-topped containers.

U.S. Pat. No. 3,594,834 to Steensen discloses a folding boat with spring-clip means to lock the two shells together in an open position.

U.S. Pat. No. 3,996,635 to Wilkes et al. discloses a nestable multi-section boat assembly.

While these devices fulfill their respective, particular objective and requirements, the aforementioned patents do not describe a folding boat and trailer for providing an easy to assemble and easily transportable boat.

In this respect, the folding boat and trailer according to the present invention substantially departs from the conventional concepts and designs of the prior art, and in doing so provides an apparatus primarily developed for the purpose of providing an easy to assemble and easily transportable boat.

Therefore, it can be appreciated that there exists a continuing need for new and improved folding boat and trailer which can be used for providing an easy to assemble and easily transportable boat. In this regard, the present invention substantially fulfills this need.

SUMMARY OF THE INVENTION

In the view of the foregoing disadvantages inherent in the known types of folding boats now present in the prior art, the present invention provides an improved folding boat and trailer. As such, the general purpose of the present invention, which will be described subsequently in greater detail, is to provide a new and improved folding boat and trailer and method which has all the advantages of the prior art and none of the disadvantages.

To attain this, the present invention essentially comprises a front section having an inner surface, an outer surface, an open top, a closed bottom, a back end, and two side walls. The two side walls each have a first end secured to opposite sides of the back end and a second end, each of which, extends to join the other to form a pointed front end. The back end has an upper transverse portion and a lower transverse portion. The outer surface of the lower transverse portion has a female keel integral therewith. The female keel has two apertures formed therethrough. An upper seat portion is secured between the inner surface of the two side walls. The two side walls each have a cleat that is secured to an upper surface thereof. The device contains a back section having a generally rectangular configuration. The back section has an inner surface, an outer surface, an open top, a closed bottom, a front end, a back end, and two side walls. The front end has an upper transverse portion and a lower transverse portion. The outer surface of the lower transverse portion has a male keel integral therewith. The male keel has two apertures therethrough. The upper transverse portion is hingedly secured to the upper transverse portion of the front section. The back section closes over the front section in a closed configuration. In an extended configuration, the lower transverse portion of the back section adjoins the lower transverse portion of the front section with the male keel cooperating with the female keel with the associated apertures in alignment and secured together by nuts and bolts. The back end has pieces of plywood on the inner surface and the outer surface thereof. The plywood serves as a means of mounting a motor to the back section. Two metal braces each have a first end secured to the inner surface of the back end and a second end secured to an opposing side wall. The back section has two seat portions. Each of the seat portions is secured between the inner surface of the two side walls. The two side walls each have an oar holder secured to an upper surface thereof. The device contains a trailer having an upper section, a lower section, a front section, and a back section. The lower section has an axle secured thereto. The axle has two end portions. A wheel is secured to each of the two end portions. The upper section has tie down cables secured to side portions thereof. The front section has a hitch that extends outwardly therefrom. The hitch serves to couple with a car or truck. The trailer receives the device in a closed configuration for transportation. The tie down cables couple with the cleats of the front section for securement thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved folding boat and trailer which has all the advantages of the prior art folding boats and none of the disadvantages.

It is another object of the present invention to provide a new and improved folding boat and trailer which may be easily and efficiently manufactured and marketed.

It is a further object of the present invention to provide a new and improved folding boat and trailer which is of durable and reliable construction.

An even further object of the present invention is to provide a new and improved folding boat and trailer which is susceptible of a low cost of manufacture with regard to both materials and labor, and which accordingly is then susceptible of low prices of sale to the consuming public, thereby making such a folding boat and trailer economically available to the buying public.

Still yet another object of the present invention is to provide a new and improved folding boat and trailer which provides in the apparatuses and methods of the prior art some of the advantages thereof, while simultaneously overcoming some of the disadvantages normally associated therewith.

Even still another object of the present invention is to provide a new and improved folding boat and trailer for providing an easy to assemble and easily transportable boat.

Lastly, it is an object of the present invention to provide a new and improved folding boat and trailer comprising a front section having an upper transverse portion and a lower transverse portion. The lower transverse portion has a female keel integral therewith. The female keel has two apertures formed therethrough. Included in the device is a back section having a generally rectangular configuration. The back section has an upper transverse portion and a lower transverse portion. The lower transverse portion has a male keel integral therewith. The male keel has two apertures therethrough. The upper transverse portion is hingedly secured to the upper transverse portion of the front section. The back section closes over the front section in a closed configuration. In an extended configuration the lower transverse portion of the back section adjoins the lower transverse portion of the front section with the male keel cooperating with the female keel with the associated apertures in alignment and secured together by nuts and bolts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
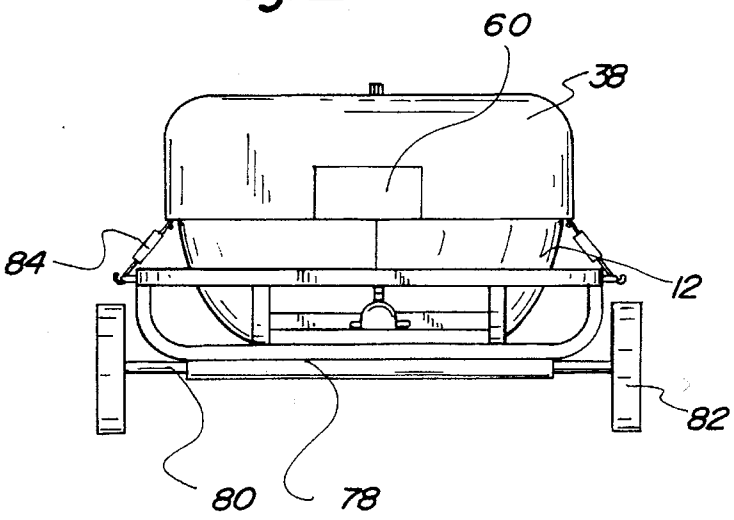
FIG. 2 is a front elevational view of the present invention.
Figure 1:
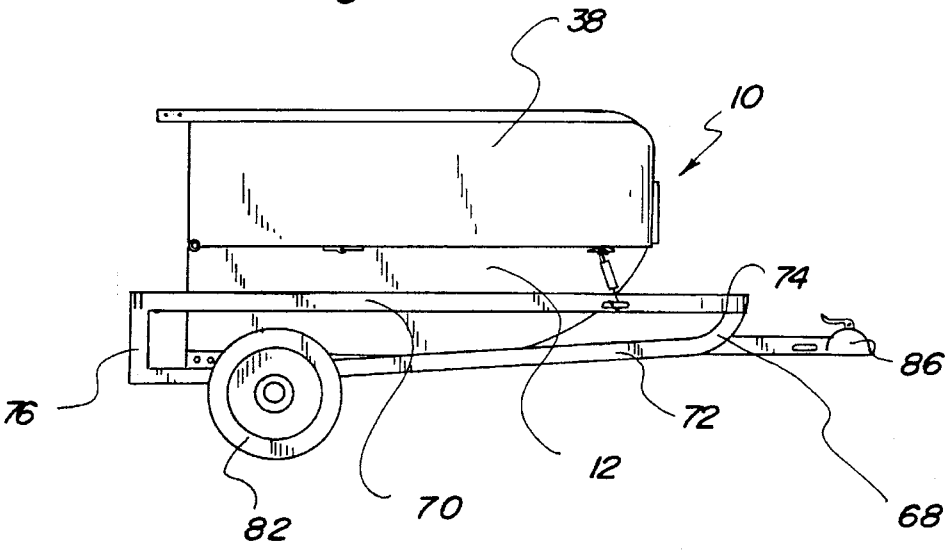
FIG. 1 is a perspective view of the preferred embodiment of the folding boat and trailer constructed in accordance with the principles of the present invention.
Figure 3:
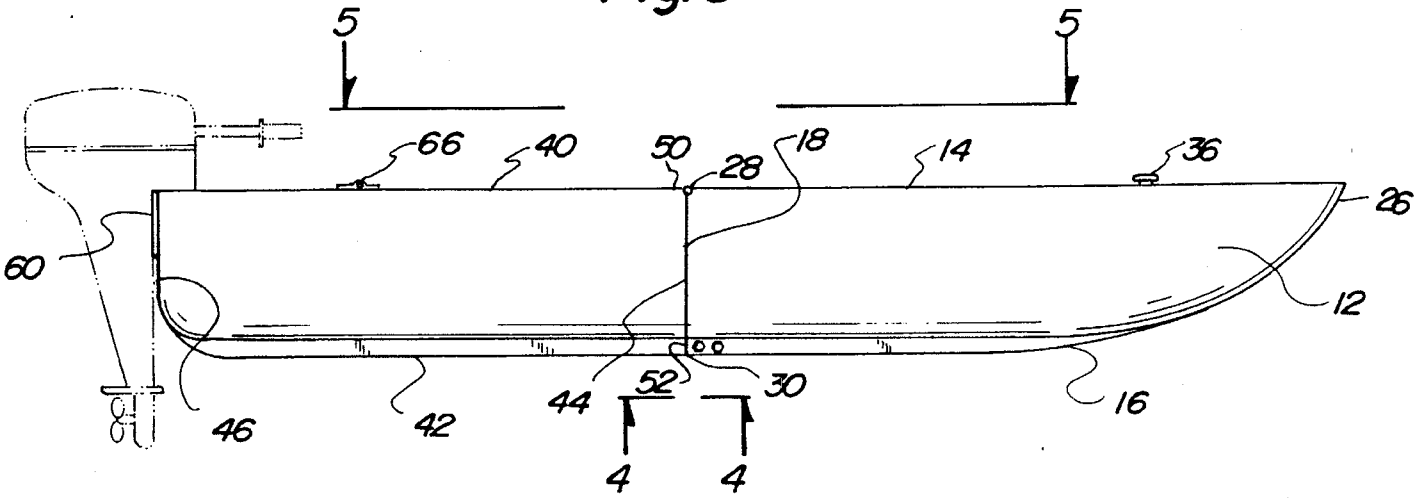
FIG. 3 is a side elevational view of the present invention in an extended position.
Figure 4:
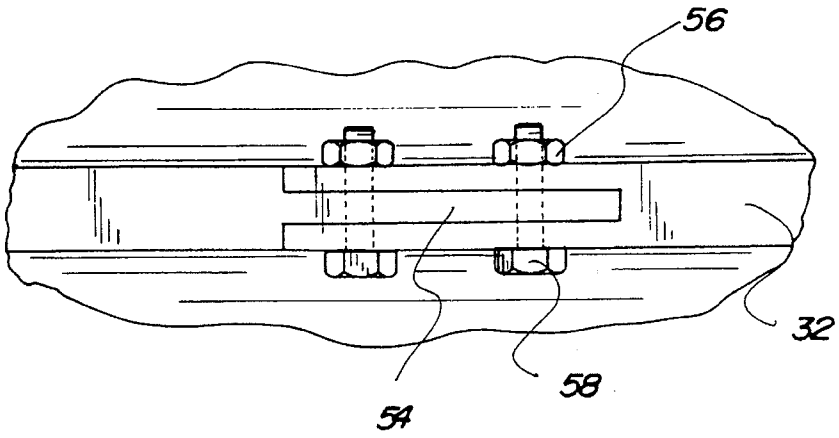
FIG. 4 is a cross-sectional view as seen along line 4—4 of FIG. 3.
Figure 5:
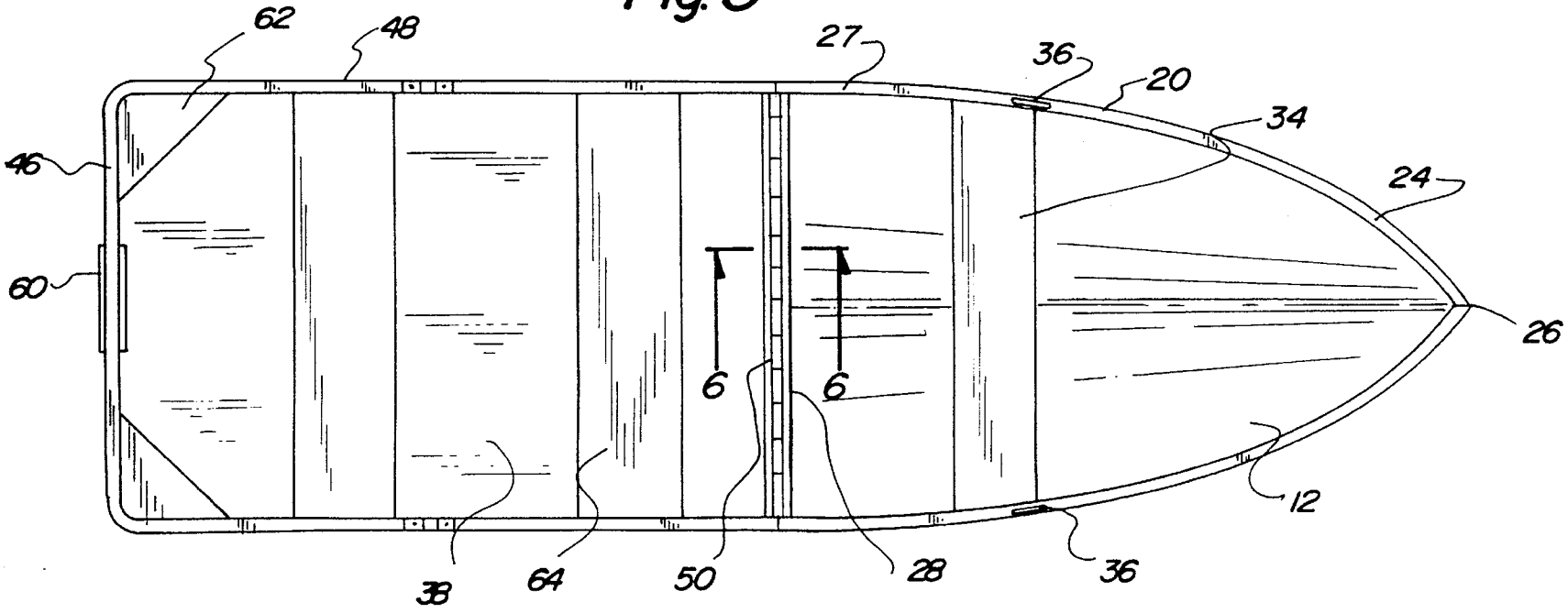
FIG. 5 is a plan view of the present invention in an extended position.
Figure 6:
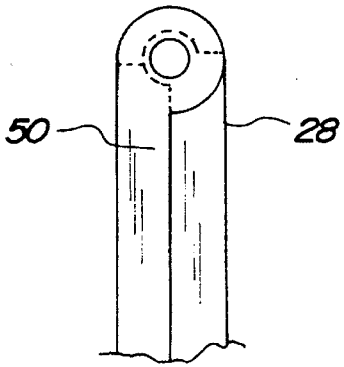
FIG. 6 is a cross-sectional view as seen along line 6—6 of FIG. 5.

With reference now to the drawings, and in particular, to FIG. 1 thereof, the preferred embodiment of the new and improved folding boat and trailer embodying the principles and concepts of the present invention and generally designated by the reference number 10 will be described.

Specifically, it will be noted in the various Figures that the device relates to a new and improved folding boat and trailer for providing an easy to assemble and easily transportable boat. In its broadest context, the device consists of a front section, a back section, and a trailer.

The device 10 contains a front section 12 having an inner surface, an outer surface, an open top 14, a closed bottom 16, a back end 18, and two side walls 20. The two side walls 20 each have a first end 22 secured to opposite sides of the back end 18 and a second end 24, each of which, extends to join the other to form a pointed front end 26. The back end 18 has an upper transverse portion 28 and a lower transverse portion 30. The outer surface of the lower transverse portion 30 has a female keel 32 integral therewith. The female keel 32 has two apertures formed therethrough. An upper seat portion 34 is secured between the inner surface of the two side walls 20. The upper seat portion 34 will comfortably seat one or two people. The two side walls 20 each have a cleat 36 that is secured to an upper surface thereof. The front section 12 can be constructed of fiberglass and aluminum, with the female keel 32 constructed of copper or brass. Fiberglass allows the device 10 to be lightweight, but durable, for easy transportation.

The device 10 contains a back section 38 having a generally rectangular configuration. The back section 38 has an inner surface, an outer surface, an open top 40, a closed bottom 42, a front end 44, a back end 46, and two side walls 48. The front end 44 has an upper transverse portion 50 and a lower transverse portion 52. The outer surface of the lower transverse portion 52 has a male keel 54 integral therewith. The male keel 54 has two apertures therethrough. The upper transverse portion 50 is hingedly secured to the upper transverse portion 28 of the front section 12. The back section 38 closes over the front section 12 in a closed configuration. In a closed configuration, the front section 12 and back section 38 can be stored and transported within a bed of a pick-up truck. In an extended configuration, the lower transverse portion 52 of the back section 38 adjoins the lower transverse portion 30 of the front section 12 with the male keel 54 cooperating with the female keel 32 with the associated apertures in alignment and secured together by nuts 56 and bolts 58. The male keel 54 is constructed of copper or brass to prevent rusting. The extended configuration allows the device 10 to be placed in the water for uses such as fishing, swimming, or just to relax. The back end 46 has pieces of plywood 60 on the inner surface and the outer surface thereof. The plywood 60 serves as a means of mounting a motor to the back section 46. Two metal braces 62 each have a first end secured to the inner surface of the back end 46 and a second end secured to an opposing side wall 48. The back section 38 has two seat portions 64. Each of the seat portions 64 is secured between the inner surface of the two side walls 48. Each of the seat portions 64 comfortably seat one or two people. The two side walls 48 each have an oar holder 66 secured to an upper surface thereof.

The device 10 contains a trailer 68 having an upper section 70, a lower section 72, a front section 74, and a back section 76. The lower section 72 has an axle 78 secured thereto. The axle 78 has two end portions 80. A wheel 82 is secured to each of the two end portions 80. The upper section 70 has tie down cables 84 secured to side portions thereof. The front section 74 has a hitch 86 that extends outwardly therefrom. The hitch 86 serves to couple with a car or truck. The trailer 68 receives the device 10 in a closed configuration for transportation. The tie down cables 84 couple with the cleats 36 of the front section 12 for securement thereto.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved folding boat and trailer for providing an easy to assemble and easily transportable boat comprising, in combination:

a front section having an inner surface, an outer surface, an open top, a closed bottom, a back end, and two side walls, the two side walls each having a first end secured to opposite sides of the back end and a second end each extending to join the other to form a pointed front end, the back end having an upper transverse portion and a lower transverse portion, the outer surface of the lower transverse portion having a permanent female keel integral therewith, the female keel having two apertures formed therethrough, an upper seat portion secured between the inner surface of the two side walls, the two side walls each having a cleat secured to an upper surface thereof;

a back section having a generally rectangular configuration, the back section having an inner surface, an outer surface, an open top, a closed bottom, a front end, a back end, and two side walls, the front end having an upper transverse portion and a lower transverse portion, the outer surface of the lower transverse portion having a permanent male keel integral therewith, the male keel having two apertures therethrough, the upper transverse portion hingedly secured to the upper transverse portion of the front section, the back section closing over the front section in a closed configuration, in an extended configuration the lower transverse portion of the back section adjoining the lower transverse portion of the front section with the male keel cooperating with the female keel with the associated apertures in alignment and secured together by nuts and bolts, the back end having pieces of plywood on the inner surface and the outer surface thereof, the plywood serving as a means of mounting a motor to the back section, two metal braces each having a first end secured to the inner surface of the back end and a second end secured to an opposing side wall, the back section having two seat portions, each of the seat portions secured between the inner surface of the two side walls, the two side walls each having an oar holder secured to an upper surface thereof;

a trailer having an upper section, a lower section, a front section, and a back section, the lower section having an axle secured thereto, the axle having two end portions, a wheel secured to each of the two end portions, the upper section having tie down cables secured to side portions thereof, the front section having a hitch extending outwardly therefrom, the hitch serving to couple with a car or truck, the trailer receiving the device in a closed configuration for transportation, the tie down cables coupling with the cleats of the front section for securement thereto.

* * * * *